US007017596B2

(12) United States Patent
Park

(10) Patent No.: US 7,017,596 B2
(45) Date of Patent: Mar. 28, 2006

(54) APPARATUS FOR WASHING HAIRCUTTING AND HAIRDRESSING INSTRUMENTS USING ULTRASONIC WAVES

(75) Inventor: Jeung Hoon Park, Seoul (KR)

(73) Assignee: Beaunix Co., Ltd., Seoul (KR)

( * ) Notice: Subject to any disclaimer, the term of this patent is extended or adjusted under 35 U.S.C. 154(b) by 355 days.

(21) Appl. No.: 10/211,397

(22) Filed: Aug. 2, 2002

(65) Prior Publication Data

US 2003/0037810 A1 Feb. 27, 2003

(30) Foreign Application Priority Data

Aug. 21, 2001 (KR) ..... P2001-50269

(51) Int. Cl.
*B08B 3/10* (2006.01)

(52) U.S. Cl. ..... 134/56 R; 134/135; 134/186

(58) Field of Classification Search ..... 123/135, 123/200, 184, 186, 56 R, 58 R
See application file for complete search history.

(56) References Cited

U.S. PATENT DOCUMENTS 1,747,681 A * 2/1930 Schimmel ..... 118/503
2,878,820 A * 3/1959 Carr, Jr. ..... 134/122 R
2,896,649 A * 7/1959 Faidley ..... 134/184
2,994,330 A * 8/1961 Catlin et al. ..... 134/58 R
3,291,458 A * 12/1966 Hamm ..... 366/110
3,365,267 A * 1/1968 Mekiney et al. ..... 422/116
3,660,860 A * 5/1972 Dziuk ..... 15/94
3,709,732 A * 1/1973 Thomen ..... 134/57 D
3,720,402 A * 3/1973 Cummins et al. ..... 366/114
3,759,594 A * 9/1973 Cobb ..... 312/31
3,771,772 A * 11/1973 Honda ..... 366/110
3,834,409 A * 9/1974 Kuparinen ..... 134/117
3,871,395 A * 3/1975 Murry ..... 134/107
3,873,071 A * 3/1975 Tatebe ..... 366/113
4,082,565 A * 4/1978 Sjolander ..... 134/1
4,130,444 A * 12/1978 Anderka ..... 134/96.1
4,409,999 A * 10/1983 Pedziwiatr ..... 134/95.2
4,710,233 A * 12/1987 Hohmann et al. ..... 205/701
4,727,896 A * 3/1988 Kanazawa et al. ..... 134/184
5,076,305 A * 12/1991 Williams ..... 134/58 R
5,097,967 A * 3/1992 Sica ..... 211/66
5,202,523 A * 4/1993 Grossman et al. ..... 42/95
5,251,752 A * 10/1993 Purohit ..... 206/352

(Continued)

FOREIGN PATENT DOCUMENTS

DE 36 33 046 * 1/1988

(Continued)

*Primary Examiner*—Frankie L. Stinson
(74) *Attorney, Agent, or Firm*—Ladas & Parry LLP

(57) ABSTRACT

The present invention relates to an apparatus for washing a haircutting and hairdressing instrument using ultrasonic wave capable of removing dusts attached to a haircutting and hairdressing instrument by submerging the same in a washing liquid filled in a washing container in which a ultrasonic wave generator is installed. The apparatus according to the present invention includes a washing container which includes an opened upper portion, an outlet formed in a lower portion of the same and receives a haircutting and hairdressing instrument washing liquid therein, a ultrasonic wave generator installed in a side surface of the washing container, a body in which the washing container is provided on an upper surface of the same and a control boxy is installed therein for controlling a power supply to the ultrasonic wave generator, and a controller which is formed in an outer side surface of the body and controls an operation of the ultrasonic wave generator.

6 Claims, 4 Drawing Sheets

U.S. PATENT DOCUMENTS

| | | | | |
|---|---|---|---|---|
| 5,906,216 | A * | 5/1999 | Barlet | 134/58 R |
| 6,305,391 | B1 * | 10/2001 | Hoser | 134/111 |
| 6,568,409 | B1 * | 5/2003 | Fleck | 134/110 |
| 6,626,194 | B1 * | 9/2003 | Wong | 134/102.2 |
| 2002/0017316 | A1 * | 2/2002 | Ochiai | 134/102.1 |

FOREIGN PATENT DOCUMENTS

| | | | |
|---|---|---|---|
| DE | 198 07 828 | * | 8/1998 |
| FR | 2642996 | * | 8/1990 |
| JP | 54-103269 | * | 8/1979 |
| JP | 2001-96082 | * | 4/2001 |

* cited by examiner

APPARATUS FOR WASHING HAIRCUTTING AND HAIRDRESSING INSTRUMENTS USING ULTRASONIC WAVES

BACKGROUND OF THE INVENTION

1. Field of the Invention

The present invention relates to an apparatus for washing a haircutting and hairdressing instrument using a ultrasonic wave which is capable of washing and sterilizing a foreign substance such as hairs, mold bacteria, dusts, etc., attached to a haircutting and hairdressing instrument such as scissors or comb used in a haircutting and hairdressing shop using a ultrasonic wave. In more detail, the present invention relates to a washing apparatus which is capable of easily removing a foreign substance attached to a haircutting and hairdressing instrument by submerging the same into a washing liquid, based on a vibration and foam of a fluid generated by a ultrasonic wave which is generated by a ultrasonic wave generator installed in the interior of a washing container with a washing liquid.

2. Description of the Background Art

Generally, people frequently visit a haircutting and hairdressing shop for forming their hairs beautifully. In addition, people visit a haircutting and hairdressing shop for the purposes of mainly making their hairs cut and forming a perm and receiving various beauty services such as a face massage or shaving service. At this time, the haircutting and hairdressing instruments such as scissors, shaving set, comb, etc. are commonly used for all customers.

Therefore, if the scissors or comb which is used for making a certain customer's hair cut, who suffers from a certain disease in his head portion or has various bacteria in his head, the above scissors or comb may be commonly used for the next customer. In this case, various disease or bacteria may be infected to another user through the above various haircutting and hairdressing instruments, so that it is impossible to implement a certain sanitation management.

In order to overcome the above problems, a washing and sterilizing apparatus which is exclusively used for a hairdressing and haircutting instrument is used. However, since all the haircutting and hairdressing instruments are washed and sterilized before an initial start of the business of the shop or after the last of the business, it is impossible to frequently wash and sterilize the haircutting and hairdressing instruments during a haircutting service. Therefore, it is impossible to implement a certain sanitation degree of the haircutting and hairdressing instruments.

SUMMARY OF THE INVENTION

Accordingly, it is an object of the present invention to provide an apparatus for washing a haircutting and hairdressing instrument using a ultrasonic wave which overcomes the problems encountered in the conventional art.

It is another object of the present invention to provide an apparatus for washing a haircutting and hairdressing instrument using a ultrasonic wave which is capable of enhancing a sanitation degree of a haircutting and hairdressing instrument which are commonly used in a hairdressing and haircutting shop by frequently washing and sterilizing a haircutting and hairdressing instrument such as scissors, comb, etc.

It is further another object of the present invention to provide an apparatus for washing and a haircutting and hairdressing instrument using a ultrasonic wave which is capable of preventing a customer from being infected with a certain disease through a haircutting and hairdressing instrument as a hairdressing and haircutting instrument is separated into a before service and an after service instrument.

To achieve the above objects, there is provided an apparatus for washing a haircutting and hairdressing instrument using a ultrasonic wave which includes a washing container which includes an opened upper portion, an outlet formed in a lower portion of the same and receives a haircutting and hairdressing instrument washing liquid therein, a ultrasonic wave generator installed in a side surface of the washing container, a body in which the washing container is provided on an upper surface of the same and a control boxy is installed therein for controlling a power supply to the ultrasonic wave generator, and a controller which is formed in an outer side surface of the body and controls an operation of the ultrasonic wave generator.

In addition, in the present invention, a cover is hinged to an upper portion of the washing container for thereby being opened and closed.

An outer hanger is formed in an outer surface of the washing container, so that a haircutting and hairdressing instrument is hung to the outer hanger.

There is further provided a solenoid valve which is driven in response to an externally supplied power for thereby opening and closing the outlet.

The ultrasonic wave generator is installed in an inner side surface of the washing container.

The ultrasonic wave generator is installed in an inner bottom surface of the washing container.

A second hanger is installed in an inner side surface of the washing container in such a manner that a haircutting and hairdressing instrument is hung thereto for washing the same with the second hanger being submerged in the washing liquid.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The apparatus for washing a haircutting and hairdressing instrument using a ultrasonic wave according to the present invention will be described with reference to the accompanying drawings.

Figure 1:
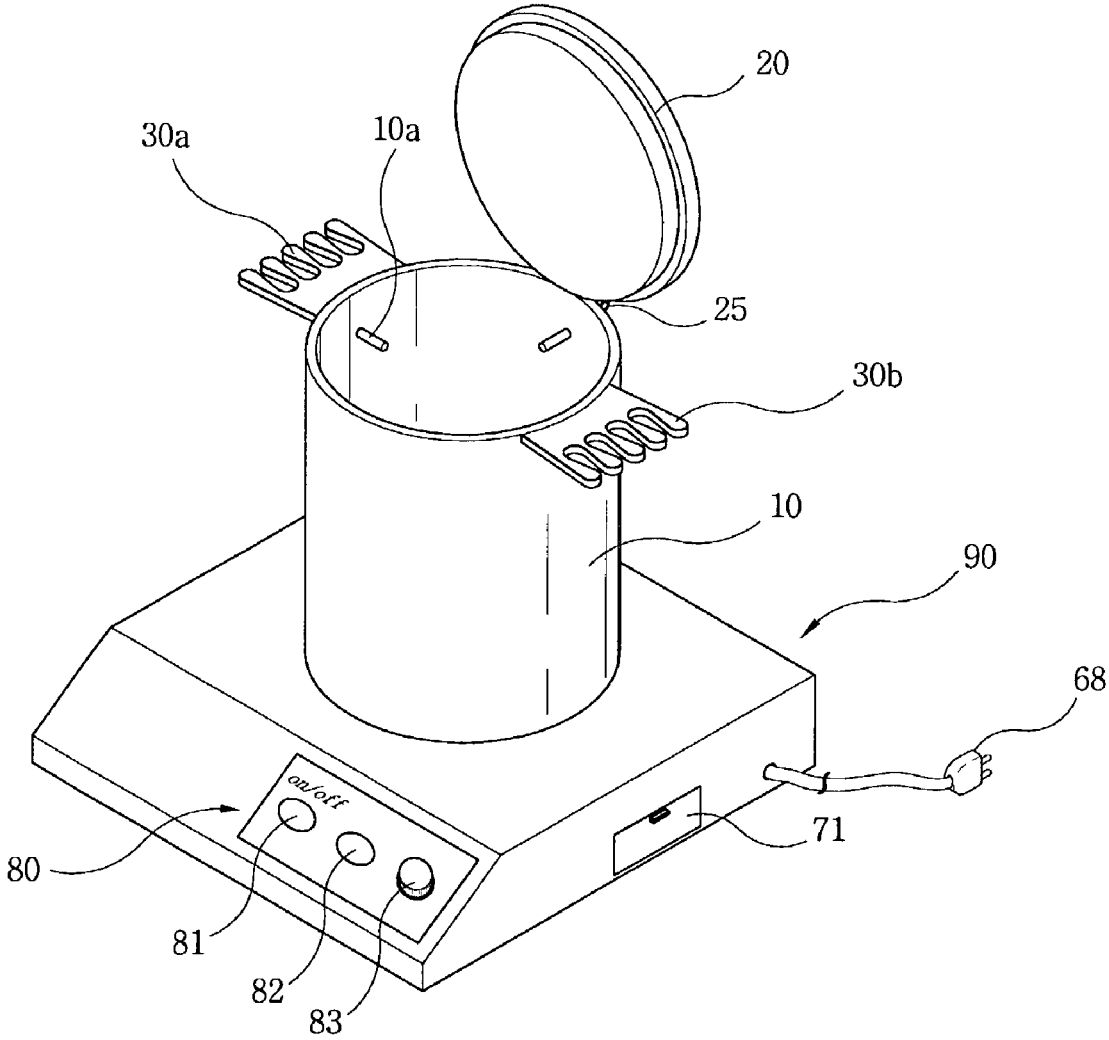
FIG. 1 is a perspective view illustrating a washing apparatus according to a preferred embodiment of the present invention.
Figure 2:
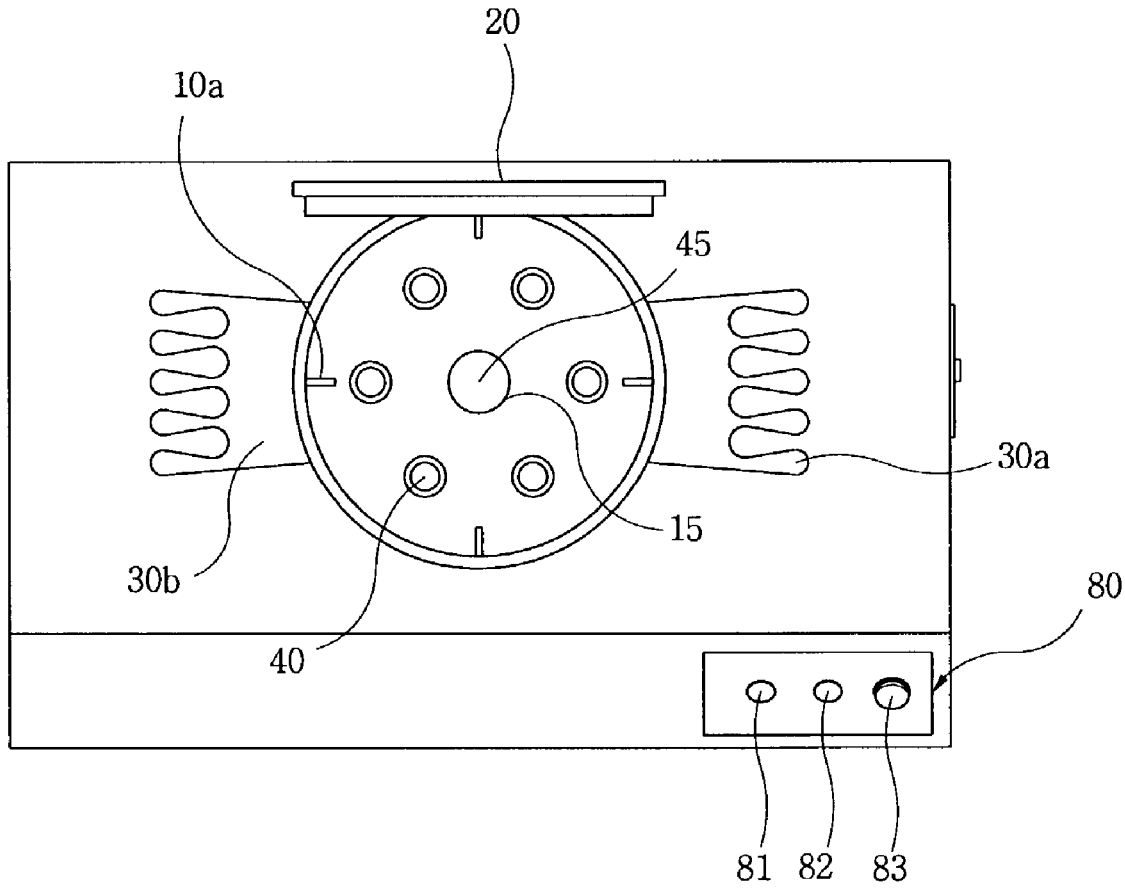
FIG. 2 is a plan view illustrating a washing apparatus of FIG. 1.
Figure 3:
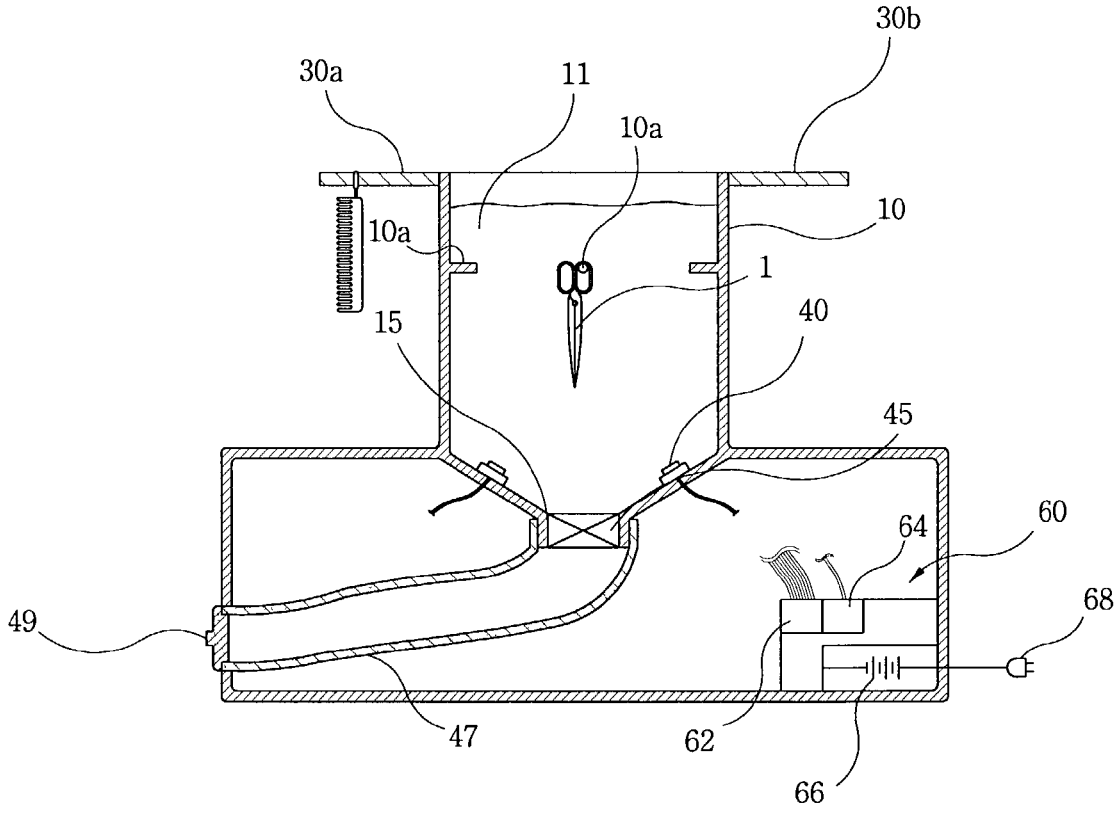
FIG. 3 is a cross-sectional view illustrating a washing apparatus of FIG. 1.
Figure 4:
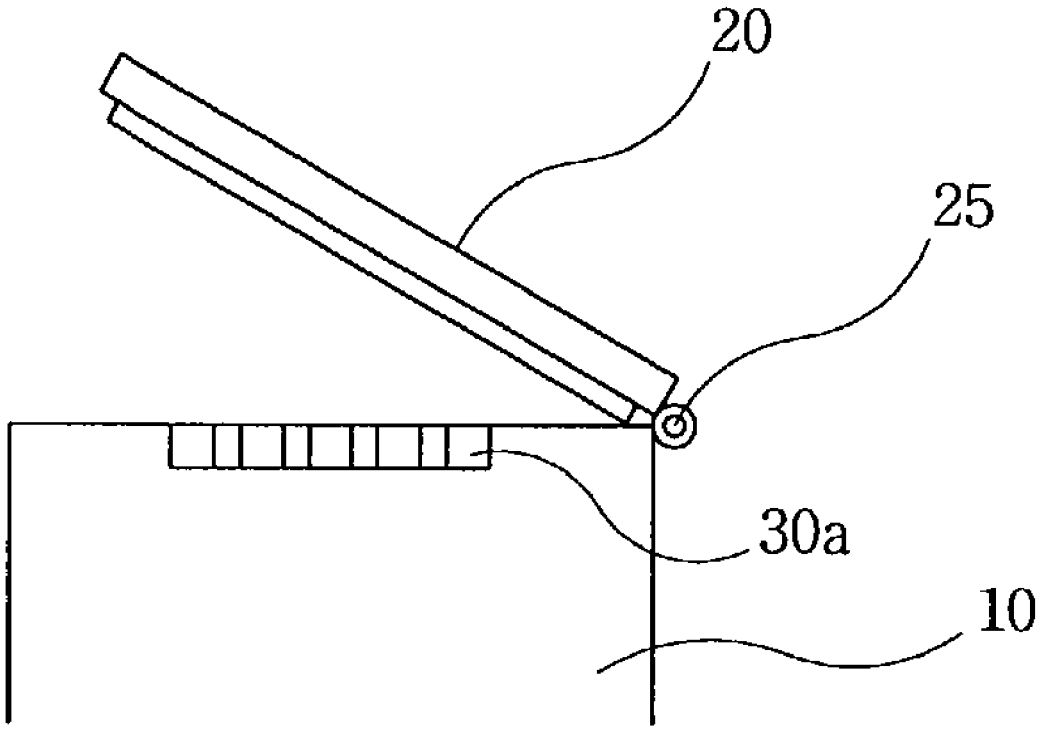
FIG. 4 is a schematic view illustrating an operation that a cover of a washing apparatus is opened and closed according to the present invention.

FIG. 1 is a perspective view illustrating a washing apparatus according to the present invention, and FIG. 3 is a cross-sectional view illustrating a washing apparatus according to the present invention.

As shown therein, the washing apparatus according to the present invention includes a washing container 10 in which a cover 20 is hinged to an opened upper portion of the washing container 10 for thereby being closed and opened by a hinge 25, an outlet 15 is formed in a lower portion of the washing container 10, an inner hanger 10*a* is formed in an inner wall of the same in such a manner that the inner hanger is submerged within a haircutting and hairdressing instrument washing liquid 11 in order for a haircutting and hairdressing instrument 1 to be detachably hung thereto, and outer hangers 30*a* and 30*b* are formed in an outer surface of the washing container 10 wherein an inner bottom surface of the washing container 10 is inclined for thereby implementing an easier discharge of the washing liquid 11.

A body 90 includes a plurality of ultrasonic wave generators 40 installed in an inner side surface or inner bottom surface of the washing container 10 for thereby generating vibration and foams in the washing liquid 11 as a power is externally supplied, a battery charger 66 in which the washing container 10 is provided on the same for thereby storing an externally supplied power through a plug 68, a variable resistor 62 for adjusting an operation of the ultrasonic wave generator 40, and a control box 60 formed of a detector 64 for supplying a power to a solenoid valve 45 which opens and closes the outlet 15 or disconnecting the power.

A controller 80 which is installed in an outer side surface of the body 90 includes a button 81 for turning on/off the power for thereby controlling a start and stop of the operation of the ultrasonic wave generator 40, a driving button 82 for driving the solenoid valve 45 for thereby discharging a washing liquid 11 by opening the outlet 15, and an adjusting knob 83 for adjusting the intensity of the ultrasonic wave which is generated by the ultrasonic generator 40 based on the revolution.

In the drawings, reference numeral 47 represents a discharge pipe which includes an inlet side communicating with the outlet 15 and an outlet side formed in an outer side of the body 90, 49 represents a cover which is detachably coupled to an outlet side of the outlet pipe 47, and 71 represents a receiving box which is opened and closed in a side surface of the body 90 for thereby receiving the plug 68 therein.

The operation of the apparatus for washing a haircutting and hairdressing apparatus using a ultrasonic wave according to the present invention will be described with reference to the accompanying drawings.

As shown in FIGS. 1 through 4, a hairstylist hangs a haircutting and hairdressing instrument 1 such as a scissor or comb which is currently used by the hairstylist to an outer hanger 30*a* formed in an outer surface of the washing container 10 as shown in FIG. 3. The haircutting and hairdressing instruments which are used for the customers, are hung to an inner hanger 10*a* formed in an inner side surface of the washing container 10 by opening the over 20.

As the user, hairstylist, touches the power on/off button 81 of the controller 80 formed in an outer side surface of the body 90, the power is supplied to the ultrasonic wave generator 40 for thereby generating ultrasonic waves. Namely, fine vibration and foams are generated in the washing liquid 11 filled in the washing container 10 for thereby removing a foreign substance such as hairs, mold bacteria, accumulated dusts, etc., which are attached to the haircutting and hairdressing instrument, so that it is possible to implement a washing or sterilizing operation.

The intensity of the ultrasonic waves generated by the ultrasonic wave generator 40 is adjusted by rotating the adjusting knob 83 of the controlled 80 formed in an outer side surface of the body 90, so that it is possible to adjust the washing or sterilizing degree of the haircutting and hairdressing instrument 1 based on the number of haircutting and hairdressing instruments 1 or the degree of the pollution.

In addition, the haircutting and hairdressing instrument 1 which is washed and sterilized in the interior of the washing container 10 is ejected from the washing container 10 and is hung to the outer hanger 30*b* formed in an outer side surface of the washing container 10 for reusing the same.

At this time, since the ultrasonic generator 40 which is installed in an inner side surface of the washing container 10 and generates ultrasonic waves in the washing liquid 11 is a known art, the description of the same will be omitted.

The washing liquid 11 polluted based on the washing or sterilizing operation of the haircutting and hairdressing instrument 1 is discharged to the outside from the washing container 10 by opening the outlet 1 of the washing container 10 in response to an electric signal applied from the battery charger 66 of the control box 60 installed in the body 90 to the solenoid valve 45 in such a manner that the cover 49 coupled to the outlet side of the discharge pipe 47 is removed, and the button 82 for driving the solenoid valve 45 is operated.

When the discharge of the washing liquid 11 is finished, the cover 49 is coupled to the outlet side of the discharge pipe 47, and an electric signal applied to the solenoid valve 45 is disconnected by operating the button 82 for thereby closing the outlet 15 of the washing container 10.

As described above, the apparatus for washing a haircutting and hairdressing instrument using a ultrasonic wave according to the present invention is capable of frequently sterilizing and washing a haircutting and hairdressing instrument such as scissor, comb, etc., for thereby enhancing a sanitation of a haircutting and hairdressing instrument used in a haircutting and hairdressing shop.

In addition, in the present invention, it is possible to prevent a customer from being infected with a certain bacteria through a haircutting and hairdressing instrument by separating a haircutting and hairdressing instrument into a before instrument and an after instrument with respect to the washing and sterilizing operations.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an apparatus for washing a haircutting or hairdressing instrument using ultrasonic waves, the improvements comprising:

a washing container which includes an opened upper portion, an outlet formed in a lower portion of the same and receives a haircutting and hairdressing instrument washing liquid therein;

a ultrasonic wave generator installed in a side surface of the washing container;

a body in which the washing container is provided on an upper surface of the same and a control box is installed therein for controlling a power supply to the ultrasonic wave generator; and a controller which is formed in an outer side surface of the body and controls an operation of the ultrasonic wave generator, wherein an outer hanger is formed in an outer surface of the washing container for hanging a haircutting or hairdressing instrument on the outer hanger, and wherein a second hanger is installed in an inner side surface of the washing container in such a manner that a haircutting and hairdressing instrument is hung thereto for washing the same with the second hanger being submerged in the washing liquid.

2. The apparatus of claim 1, wherein a cover is hinged to an upper portion of the washing container for thereby being opened and closed.

3. The apparatus of claim 1, further comprising:

a solenoid valve which is driven in response to an externally supplied power for thereby opening and closing the outlet.

4. The apparatus of claim 1, wherein said ultrasonic wave generator is installed in an inner side surface of the washing container.

5. The apparatus of claim 4, wherein said ultrasonic wave generator is installed in an inner bottom surface of the washing container.

6. The apparatus of either claim 1, wherein said ultrasonic wave generator is installed in an inner bottom surface of the washing container.

* * * * *